US005704491A

United States Patent [19]

Graves

[11] Patent Number: 5,704,491

[45] Date of Patent: Jan. 6, 1998

[54] METHOD AND APPARATUS FOR DISCRIMINATING AND COUNTING DOCUMENTS

[75] Inventor: Bradford T. Graves, Arlington Heights, Ill.

[73] Assignee: Cummins-Allison Corp., Mt. Prospect, Ill.

[21] Appl. No.: 505,773

[22] Filed: Jul. 21, 1995

[51] Int. Cl.[6] ..... B07C 5/00

[52] U.S. Cl. ..... 209/534; 209/702; 271/258.01; 271/176

[58] Field of Search ..... 209/534, 702, 209/703; 271/258.01, 176

[56] References Cited

U.S. PATENT DOCUMENTS

| | | | |
|---|---|---|---|
| 4,114,804 | 9/1978 | Jones et al. | 235/476 |
| 4,334,619 | 6/1982 | Horino et al. | 209/551 |
| 4,539,702 | 9/1985 | Oka | 382/7 |
| 4,653,647 | 3/1987 | Hashimoto | 209/534 |
| 4,677,682 | 6/1987 | Miyagawa et al. | 382/7 |
| 4,681,229 | 7/1987 | Uesaka et al. | 209/534 |
| 4,747,492 | 5/1988 | Saito et al. | 209/534 |
| 5,163,672 | 11/1992 | Mennie | 271/187 |
| 5,207,788 | 5/1993 | Geib et al. | 271/122 |
| 5,295,196 | 3/1994 | Raterman et al. | 382/7 |
| 5,341,408 | 8/1994 | Melcher et al. | 377/8 |
| 5,430,664 | 7/1995 | Cargill et al. | 364/550 |
| 5,467,406 | 11/1995 | Graves et al. | 382/135 |

FOREIGN PATENT DOCUMENTS

| | | |
|---|---|---|
| WO 91/11778 | 8/1991 | WIPO . |
| WO 93/23824 | 11/1993 | WIPO . |
| WO 94/19773 | 9/1994 | WIPO . |

OTHER PUBLICATIONS

JetScan Currency Scanner/Counter, Model 4060, Operator's Manual by Cummins–Allison (Aug. 1991).

Sale of JetScan Currency Scanner/Counter, Model 4060 (Aug. 1991).

JetScan Currency Scanner/Counter, Model 4061, Operating Instructions by Cummins–Allison (Apr. 20, 1993).

Sale of JetScan Currency Scanner/Counter, Model 4061 (Apr. 20, 1993).

JetScan Currency Scanner/Counter, Model 4062, Operating Instructions by Cummins–Allison (Nov. 28, 1994).

Sale of JetScan Currency Scanner/Counter, Model 4062 (Nov. 28, 1994).

Toyocom Currency Counter, Model NS–100, "Operation Guide (Preliminary)" (Jun. 13, 1995).

Sale of Stranger Mode—Nov. 13, 1993 (Described ins IDS mailed Sep. 25, 1995).

Sale of Sort Mode A—Nov. 13, 1993 (Described in IDS mailed Sep. 25, 1995).

Sale of Sort Mode B—Jul. 20, 1994 (Described in IDS mailed Sep. 25, 1995).

*Primary Examiner*—David H. Bollinger

*Attorney, Agent, or Firm*—Arnold, White & Durkee

[57] ABSTRACT

A method and device for off-sorting documents of a specific type using a device capable of discriminating among different types of documents. A stack of documents are received in an input receptacle and transported, one at a time, past a document type discriminating unit to an output receptacle where the type of each document is discriminated. Next it is determined whether the type of a current document is a specified type. Depending on the type of the current document either (1) operation of the device is halted when the current document does have the specified type and the immediately preceding document does not have the specified type; (2) operation of the device is halted when the current document does not have the specified type and the immediately preceding document does have the specified type; or (3) operation of the device is continued.

20 Claims, 3 Drawing Sheets

METHOD AND APPARATUS FOR DISCRIMINATING AND COUNTING DOCUMENTS

FIELD OF THE INVENTION

The present invention relates, in general, to document discrimination and counting. More specifically, the present invention relates to an apparatus and method for discriminating and sorting documents such as currency bills.

BACKGROUND OF THE INVENTION

In processing stacks of documents such as currency bills, it is often desirable to sort out specific types of documents such as currency bills having a specific denomination.

SUMMARY OF THE INVENTION

Briefly, the operator of a document discriminator embodying a sorting mode according to the present invention selects a document type to be separated from the remaining document types. For example, the operator may designate $20 bills to be off-sorted from a stack of U.S. currency bills having a plurality of denominations. When a stack of currency bills is subsequently processed by the currency discriminator, the discriminator proceeds to process all bills in the stack until it encounters the first $20 bill. The discriminator then halts operation with the first $20 bill being the last bill deposited in the output receptacle of the discriminator. The operator may then remove all the bills in the output receptacle and separate the $20 bill from the other bills. The currency discriminator may restart automatically when all the bills in the output receptacle are removed or alternatively, the discriminator may be designed to require the selection of a continuation key. The discriminator then continues to process the remaining bills until it encounters the first non-$20 bill. Upon encountering the rest non-$20 bill, the discriminator halts operation with the non-$20 bill being the last bill deposited in the output receptacle. The operator may then remove all the bills in the output receptacle, separate the non-$20 bill from the preceding $20 bills, and place the bills in appropriate stacks. The discriminator then proceeds processing the remaining bills, now halting upon encountering the first $20 bill. The operation proceeds as above with the discriminator toggling between halting upon detecting the first bill not of the designated denomination and the first bill of the designated denomination. In this way, the operator may conveniently separate a designated denomination from bills having a plurality of denominations. Likewise the above operation may be repeated with the remaining bills to sort out a different denomination, for example, $10 bills. The above sorting operation is particularly suited for sorting bills in a stack wherein like denominated bills are grouped together. For example, it has been noticed that when customers make deposits at banks, the stacks of currency they give to the teller or otherwise deposit with the bank, e.g., night deposit box or automatic teller machine, tend to have bills grouped together by denomination.

The above sorting operation is particularly useful when employed with a currency discriminator having a single output receptacle. Nonetheless, the above sorting operation may be performed on multi-output receptacle discriminators as well, e.g., in a two output pocket discriminator wherein one pocket is dedicated to a specific purpose such as collecting suspect or unrecognized documents.

DETAILED DESCRIPTION OF THE PREFERRED EMBODIMENTS

Figure 1:
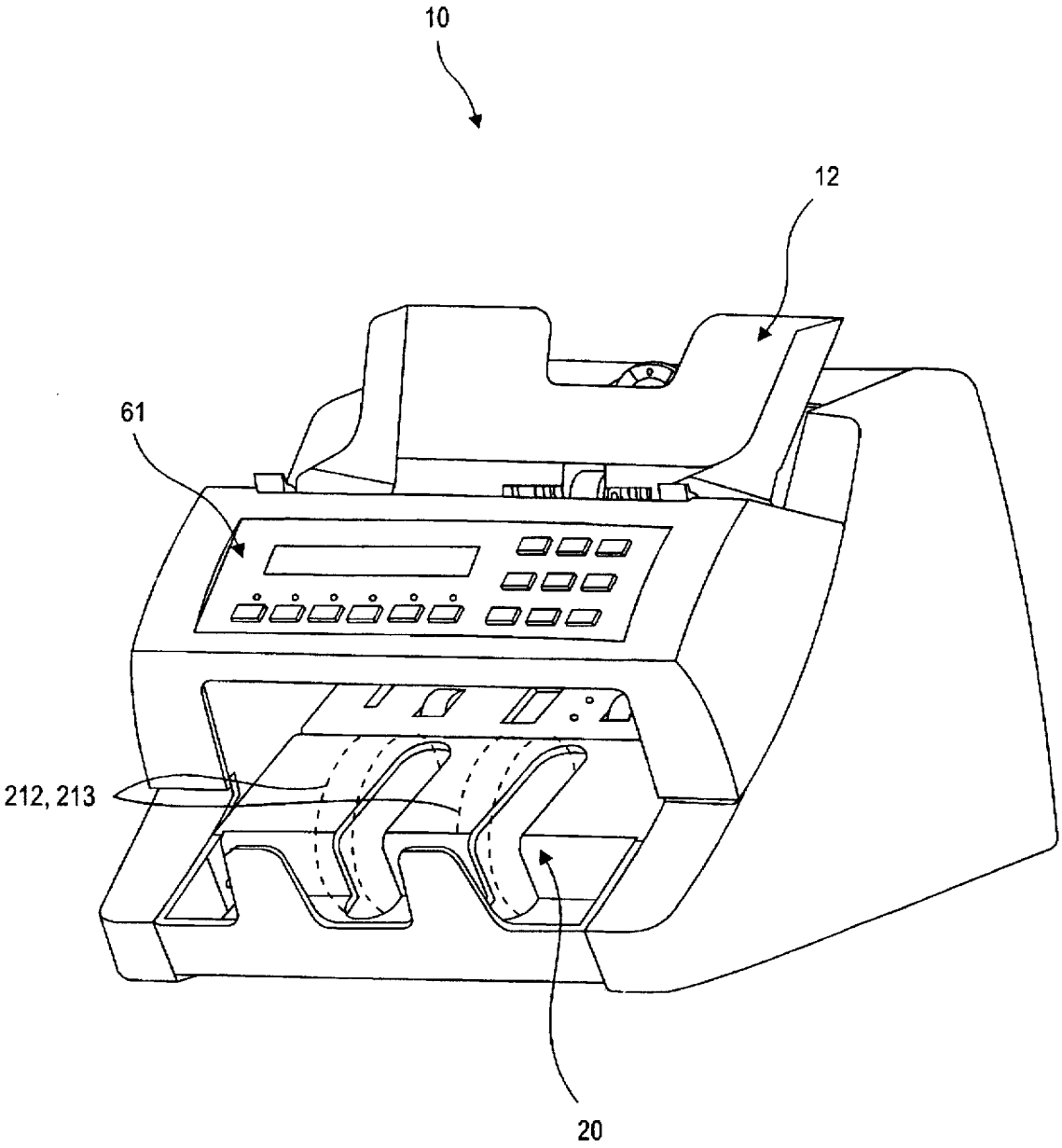
FIG. 1 is a perspective view of a currency scanning and counting machine embodying the present invention.
Figure 2:
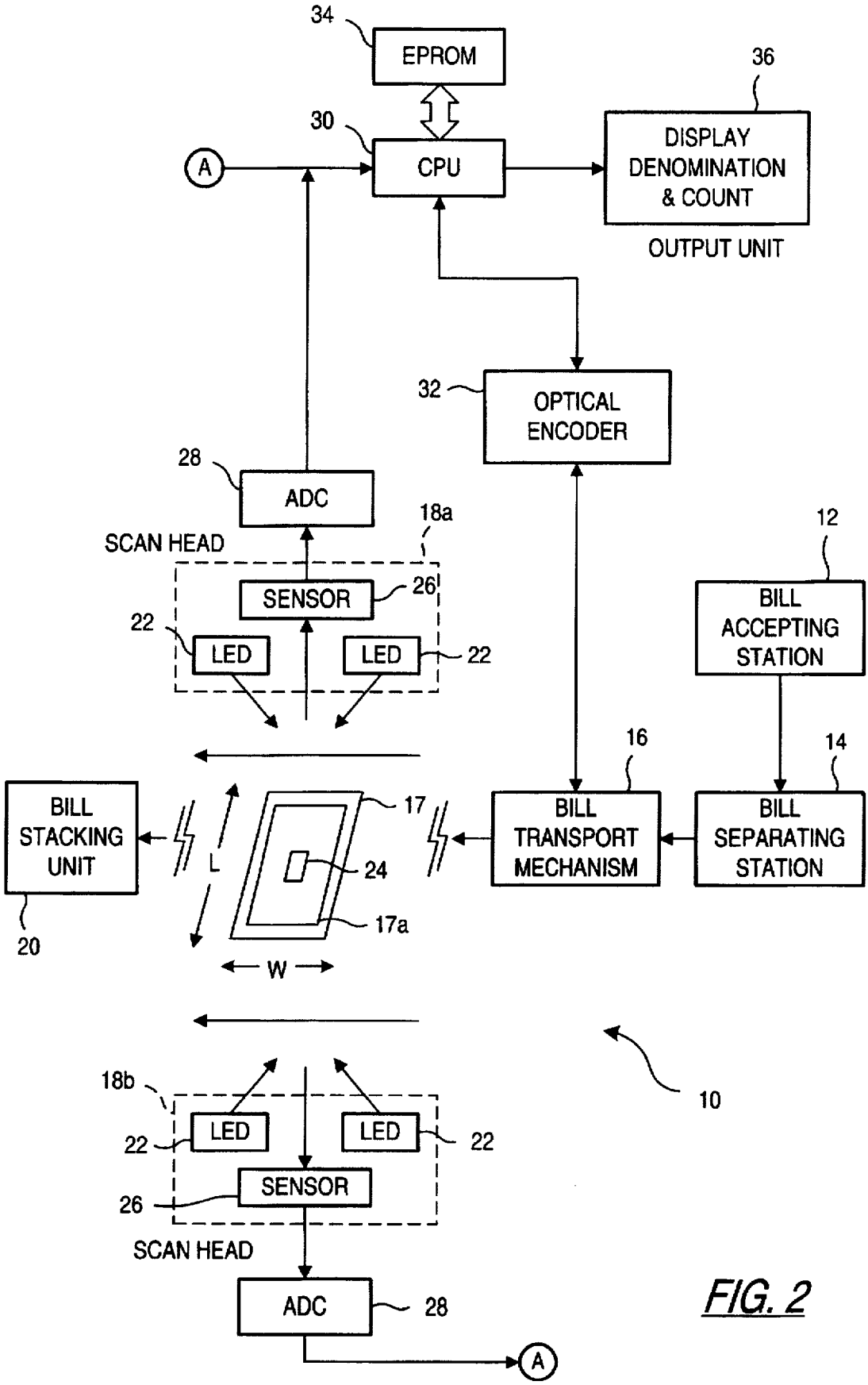
FIG. 2 is a functional block diagram of the currency scanning and counting machine of FIG. 1.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims. Referring now to FIGS. 1 and 2, there is shown an embodiment of a currency scanning and counting machine 10 that may employ a sorting mode according to the present invention. The machine 10 includes an input receptacle or bill accepting station 12 where stacks of currency bills that need to be identified and counted are positioned. Bills in the input receptacle are acted upon by a bill separating station 14 which functions to pick out or separate one bill at a time for being sequentially relayed by a bill transport mechanism 16 (FIG. 2), according to a precisely predetermined transport path, between a pair of scanheads **18*a*, 18*b* where the currency denomination of the bill is scanned and identified. In the embodiment depicted, each scanhead 18*a*, 18*b* is an optical scanhead that scans for characteristic information from a scanned bill 17 which is used to identify the denomination of the bill. The scanned bill 17 is then transported to an output receptacle or bill stacking station 20 where bills so processed are stacked for subsequent removal. As seen in FIG. 1, the output receptacle 20 comprises stacker wheels 212, 213**.

The operation of the currency scanning and counting machine 10 of FIGS. 1 and 2 is described in more detail in co-pending U.S. patent application Ser. No. 08/340,031, filed on Nov. 14, 1994 and entitled "Method and Apparatus for Discriminating and Counting Documents," which is incorporated herein by reference in its entirety. Other examples currency discrimination and processing devices which may be used in conjunction with the sorting method of the present invention are described in detail in U.S. Pat. No. 5,295,196 and co-pending U.S. patent application Ser. No. 08/433,920, filed on Mar. 7, 1995 and entitled "Automatic Currency Processing System," both of which are incorporated herein by reference in their entirety. Such discrimination systems may process bills at speeds of the order of 800 to 1500 bills per minute, including speeds in excess of 800 and 1000 bills per minute according to various embodiments.

According to an embodiment of the present invention a number of selection elements associated with individual denominations are provided. In FIG. 1, these selection elements are in the form of keys or buttons of a keypad on a control panel 61. Other types of selection elements such as switches or displayed keys in a touch-screen environment may be employed. The control panel 61 comprises a keypad and a display section. The keypad comprises a plurality of keys including denomination selection elements associated with different currency denominations, e.g., $1, $2, $5, $10, $20, $50, and $100. The keypad 62 also comprises a continuation selection element and a mode selection element. Various information such as instructions, mode selection information, authentication and discrimination information, individual denomination counter values, and total batch counter value are communicated to the operator via a display such as a LCD.

Figure 3:
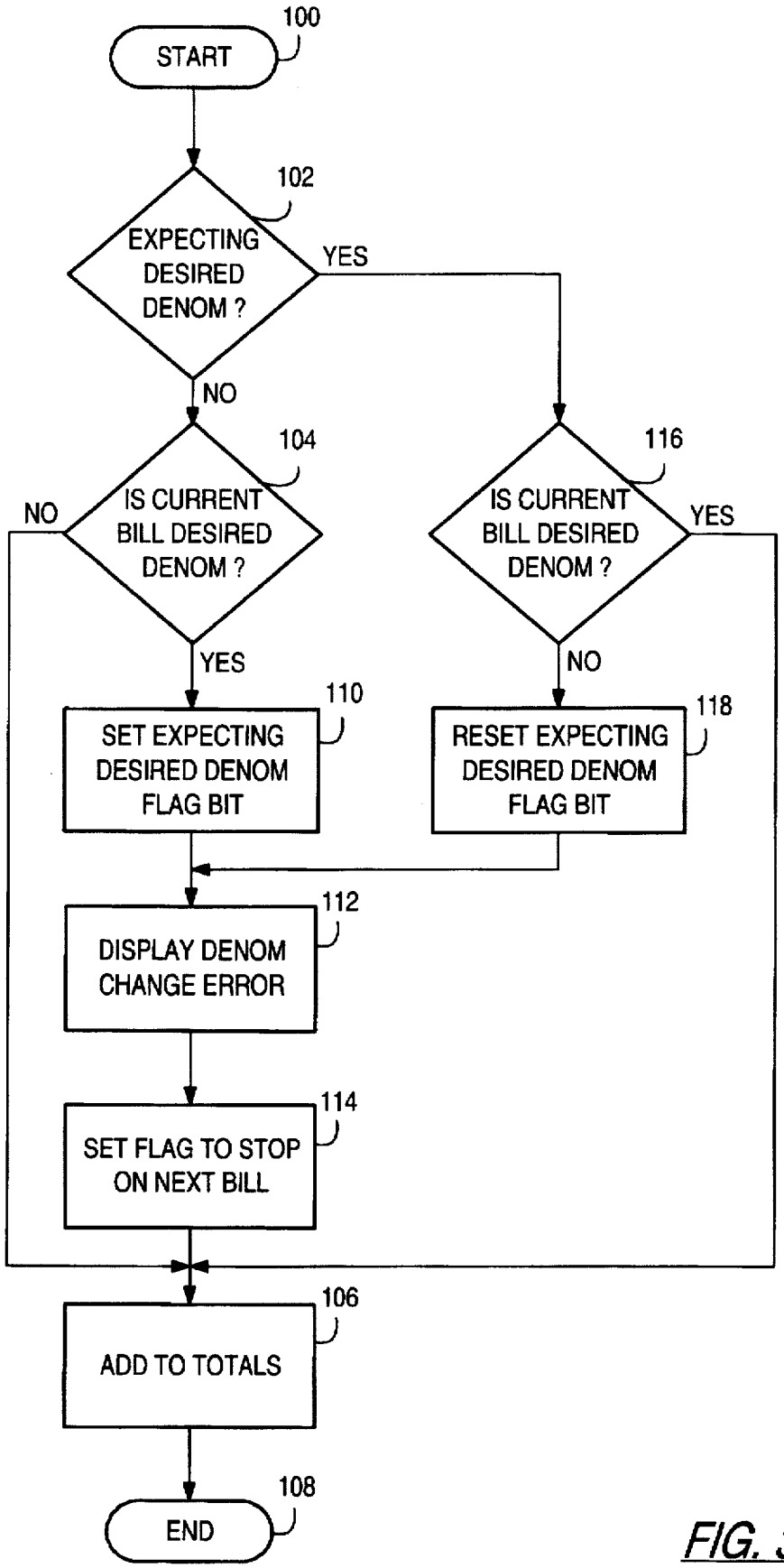
FIG. 3 is a flow chaff illustrating the sequential procedure involved in a sorting operation according to an embodiment of the present invention.

FIG. 3 is a flow chart illustrating the sequential procedure involved in the performing a sorting operation according to an embodiment of the present invention. The operator of a currency discriminating device embodying a sorting method in accordance with the present invention selects a desired denomination to be off-sorted. A stack of currency to be processed is then placed in the input receptacle of the discriminator and the discriminator begins processing the bills. The discriminator determines the denomination of each bill in the stack. A bill whose denomination the discriminator is unable to determine to a requisite degree of certainty is termed a no call bill. The discriminator may also incorporate various authentication means. A bill failing one or more authentication tests is termed a suspect bill.

The procedure of FIG. 3 begins at subroutine step 100 and it is first determined whether the discriminator is expecting the current bill to be a bill having the desired or specified denomination (step 102). If the answer is no, processing proceeds to step 104 where it is determined whether the current bill is a bill of the desired denomination. If the answer is no, the value of the current bill is added to the total (step 106) and the subroutine is ended (step 108). If the answer is yes, the next bill is also expected to be a bill of the desired denomination and accordingly a flag bit is set indicating that the next bill is expected to be a bill of the desired denomination (step 110). Subsequently, a denomination change message is displayed (step 112) and a flag is set causing the discriminator to halt operation with the current bill being the last bill deposited in the output receptacle (step 114). A flag may be set to handle the processing of the first bill in the stack so that the discriminator will not halt if the first bill has the specified denomination. The denomination change message indicates why the discriminator has stopped operating and aids in distinguishing from other reasons why the discriminator may have stopped such as the detection of a no call or suspect bill. According to one embodiment, when the discriminator flags a bill, the bill immediately upstream of the flagged bill is scanned by the discriminator before the discriminator halts and the flagged bill is the last bill output to the output receptacle. The value of the current bill is added to the total (step 106) and the subroutine is ended (step 108).

Returning to step 102, if the current bill is expected to have the desired denomination, i.e., the preceding bill had the desired denomination, the subroutine branches to step 116 where it is determined whether the current bill indeed has the desired denomination. If the current does have the desired denomination, its value is added to the running total (step 106) and the subroutine ended (step 108). If at step 116 the current bill does not have the desired denomination, the expecting the desired denomination flag bit is reset (step 118), a denomination change message is displayed (step 112), and a flag is set causing the discriminator to halt operation with the current bill being the last bill deposited in the output receptacle (step 114). The value of the current bill is added to the total (step 106) and the subroutine is ended (step 108).

For example, assume the desired off-sort denomination is selected to be $20 bills and a stack of bills having the following denominations is inserted into the input receptacle of a discriminator possessing an embodiment of the sorting operating mode according to the present invention: $1, $1, $5, $5, $1, $20 , $20, $20, $20, $5, $5, $20, $20, $20. When the stack is placed in the input receptacle or hopper, the discriminating device may automatically start processing the bills or alternatively may require the selection of a start key. The currency discriminator processes the first six bills, discriminates their denomination, totals their values, and halts with the sixth bill, i.e., the first $20 bill, being the last bill in the output receptacle. Depending on the setup of the discriminator, the discriminator may halt after one or more bills upstream of the sixth bill are scanned but before they are output to the output receptacle. The operator then removes all six bills and separates the first five bills into one pile, e.g., pile A, and the sixth bill, namely, the $20 bill, into another pile, e.g., pile B. Depending on the setup of the currency discriminator, the discriminating device may continue to process the remaining bills automatically when the stack of six bills is removed or may continue processing the remaining bills when a continue element is selected. The discriminator then processes the next four bills, discriminates their denomination, adds their values to the running total, and halts with the tenth bill, i.e., the $5 bill, being the last bill output to the output receptacle. The operator may then remove all the bills from the output receptacle, placing the three $20 bills in pile B and the last $5 bill in pile A. The discriminator then processes the next two remaining bills, discriminates their denomination, adds their values to the running total, and halts with the twelfth bill, i.e., the $20 bill, being the last bill output to the output receptacle. The operation then continues to proceed in the manner described above.

In an alternative embodiment, instead of halting the device with the flagged bill being the last bill output to the output receptacle, the device may halt with the flagged bill being at an identifiable location, e.g., the second to last bill output to the output receptacle, and the display may indicate the location of the flagged bill, e.g., "denomination changed with second to the last bill in the output bin."

I claim:

1. A method of off-sorting currency of a specific denomination using a device capable of discriminating the denomination of currency bills comprising the steps of:

receiving a stack of bills in an input receptacle;

transporting said bills, one at a time, past a denomination discriminating unit to an output receptacle;

discriminating the denomination of each bill;

determining whether the denomination of a current bill is a specified denomination; and either (1) halting operation of the device when said current bill does have said specified denomination and an immediately preceding bill does not have said specified denomination;

(2) halting operation of the device when said current bill does not have said specified denomination and said immediately preceding bill does have said specified denomination; or (3) continuing operation of the device.

2. The method of claim 1 wherein said halting steps are performed so that said current bill is the last bill output to said output receptacle when said device is halted.

3. The method of claim 2 wherein said device has a single output receptacle.

4. The method of claim 2 further comprising the step of totaling the value of said bills.

5. The method of claim 4 wherein said device has a single output receptacle.

6. The method of claim 1 wherein said device has a single output receptacle.

7. The method of claim 6 wherein said halting stops are performed so that said current bill is positioned at an identifiable location in said output receptacle when said device is halted.

8. A method of off-sorting documents of a specific type using a device capable of discriminating among different types of documents comprising the steps of:

receiving a stack of documents in an input receptacle;

transporting said documents, one at a time, past a document type discriminating unit to an output receptacle;

discriminating the type of each document;

determining whether the type of a current document is a specified type; and either (1) halting operation of the device when said current document is of said specified type and an immediately preceding document is not of said specified type;

(2) halting operation of the device when said current document is not of said specified type and said immediately preceding document is of said specified type; or (3) continuing operation of the device.

9. The method of claim 8 wherein said halting steps are performed so that said current document is the last document output to said output receptacle when said device is halted.

10. The method of claim 9 wherein said device has a single output receptacle.

11. The method of claim 9 wherein each of said documents has a value associated therewith and further comprising the step of totaling the values of said documents.

12. The method of claim 11 wherein said device has a single output receptacle.

13. The method of claim 8 wherein said device has a single output receptacle.

14. A device for off-sorting currency of a specific denomination comprising:

an input receptacle for receiving a stack of bills; and a transport mechanism for transporting said bills, one at a time, past a denomination discriminating unit to an output receptacle;

wherein said discriminating unit discriminates the denomination of each bill, determines whether a current bill has a specified denomination; and further comprising means for controlling the operation of said device so that said device either (1) halts operation when said current bill does have said specified denomination and an immediately preceding bill does not have said specified denomination;

(2) halts operation when said current bill does not have said specified denomination and said immediately preceding bill does have said specified denomination; or (3) continues operation.

15. The device of claim 14 having a single output receptacle.

16. The device of claim 15 wherein when the operation of said device is halted said current bill is the last bill output to said output receptacle.

17. The device of claim 15 wherein when the operation of said device is halted said current bill is deposited at an identifiable location in said output receptacle.

18. The device of claim 14 further comprising means for totaling the value of said bills.

19. The device of claim 18 having a single output receptacle.

20. The device of claim 19 wherein when the operation of said device is halted said current bill is the last bill output to said output receptacle.

* * * * *